US008122554B2

(12) United States Patent
Schemmel et al.

(10) Patent No.: US 8,122,554 B2
(45) Date of Patent: Feb. 28, 2012

(54) SCRUBBING DEVICE

(75) Inventors: Ryan A. Schemmel, Baltimore, MD (US); Christopher Murray, Baltimore, MD (US); Mark Stratford, Darlington (GB); Benjamin J. Strutt, Newcastle-upon-Tyne (GB); Patrick Marcil, Ottawa (CA)

(73) Assignee: Black & Decker Inc., Newark, DE (US)

( * ) Notice: Subject to any disclaimer, the term of this patent is extended or adjusted under 35 U.S.C. 154(b) by 1167 days.

(21) Appl. No.: 11/874,390

(22) Filed: Oct. 18, 2007

(65) Prior Publication Data

US 2009/0100615 A1 Apr. 23, 2009

(51) Int. Cl.

| | |
|---|---|
| ***A46B 13/04*** | (2006.01) |
| ***A47L 11/14*** | (2006.01) |
| ***A47L 11/18*** | (2006.01) |

(52) U.S. Cl. ..... 15/24; 15/29; 15/50.3; 15/98

(58) Field of Classification Search ..... 15/24, 29, 15/50.3, 98

See application file for complete search history.

(56) References Cited

U.S. PATENT DOCUMENTS

| | | | | |
|---|---|---|---|---|
| 2,917,760 | A * | 12/1959 | Baxter | 15/49.1 |
| 3,024,487 | A | 3/1962 | Jones et al. | |
| D262,670 | S | 1/1982 | Wellin | |
| 4,409,755 | A | 10/1983 | Maddock | |
| 4,552,476 | A | 11/1985 | Heraty et al. | |
| 4,778,298 | A | 10/1988 | Shin et al. | |
| D301,398 | S | 6/1989 | Cheung | |
| D311,278 | S | 10/1990 | Swanson | |
| D313,890 | S | 1/1991 | Machuron | |
| 5,423,102 | A * | 6/1995 | Madison | 15/22.2 |
| 5,718,014 | A * | 2/1998 | deBlois et al. | 15/22.1 |
| 5,735,620 | A | 4/1998 | Ford | |
| 6,425,701 | B1 | 7/2002 | Jacobs | |
| D498,057 | S | 11/2004 | Ashley et al. | |
| D501,606 | S | 2/2005 | Belt et al. | |
| D515,319 | S | 2/2006 | Ashley et al. | |
| D515,818 | S | 2/2006 | Groblebe et al. | |
| 7,044,674 | B2 | 5/2006 | Dixon et al. | |
| 7,203,986 | B2 * | 4/2007 | Pears et al. | 15/28 |
| 2005/0278880 | A1 * | 12/2005 | Pieroni et al. | 15/97.1 |

* cited by examiner

*Primary Examiner* — Randall Chin

(74) *Attorney, Agent, or Firm* — Harness, Dickey & Pierce, P.L.C.

(57) ABSTRACT

An apparatus with a main unit, a dispenser, a clamp and a clamp structure. The main unit includes a housing, a battery in the housing, a motor in the housing and connected to the battery, and an output drive shaft driven by the motor. The dispenser includes a body that defines a body aperture and which has a reservoir for storing a fluid, and a nozzle in fluid communication with the reservoir. The dispenser is configured to permit the stored fluid to be dispensed from the reservoir through the nozzle. The clamp is coupled to either the main unit or the dispenser and includes a pivotable engagement member. The clamp structure is coupled to the other one of the main unit and the dispenser and includes a second engagement member that can be releasably engaged to the engagement member. The housing is received through the body aperture.

18 Claims, 13 Drawing Sheets

SCRUBBING DEVICE

INTRODUCTION

The present invention generally relates to a hand-held cleaning apparatus and more particularly to a hand-held, motorized scrubbing tool.

Hand-held, motorized scrubbing brushes are known in the art. For example, U.S. Pat. No. 2,917,760 discloses a drill-powered floor scrubbing tool and U.S. Pat. No. 5,718,014 discloses a hand-held, motorized scrubbing brush. While such tools are effective for their intended purposes, they are nonetheless susceptible to improvement.

SUMMARY

In one form, the present teachings provide an apparatus with a main unit, a dispenser, a clamp and a clamp structure. The main unit includes a housing, a battery in the housing, a motor in the housing and connected to the battery, and an output drive shaft driven by the motor. The dispenser includes a body that defines a body aperture and which has a reservoir for storing a fluid, and a nozzle in fluid communication with the reservoir. The dispenser is configured to permit the stored fluid to be dispensed from the reservoir through the nozzle. The clamp is coupled to either the main unit or the dispenser and includes a pivotable engagement member. The clamp structure is coupled to the other one of the main unit and the dispenser and includes a second engagement member that can be releasably engaged to the engagement member. The housing is received through the body aperture.

In another form, the present teachings provide a method that includes: providing a main unit with a housing, a battery located in the housing, a motor located in the housing and coupled to the battery, and an output shaft driven by the motor; providing a dispenser having a body, the body defining a body aperture and having a reservoir; coupling a clamp to one of the main unit and the dispenser; inserting the housing to the body aperture; and pivoting the clamp relative to the clamp structure to engage the clamp to the clamp structure to thereby retain the dispenser to the main unit.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Figure 1:
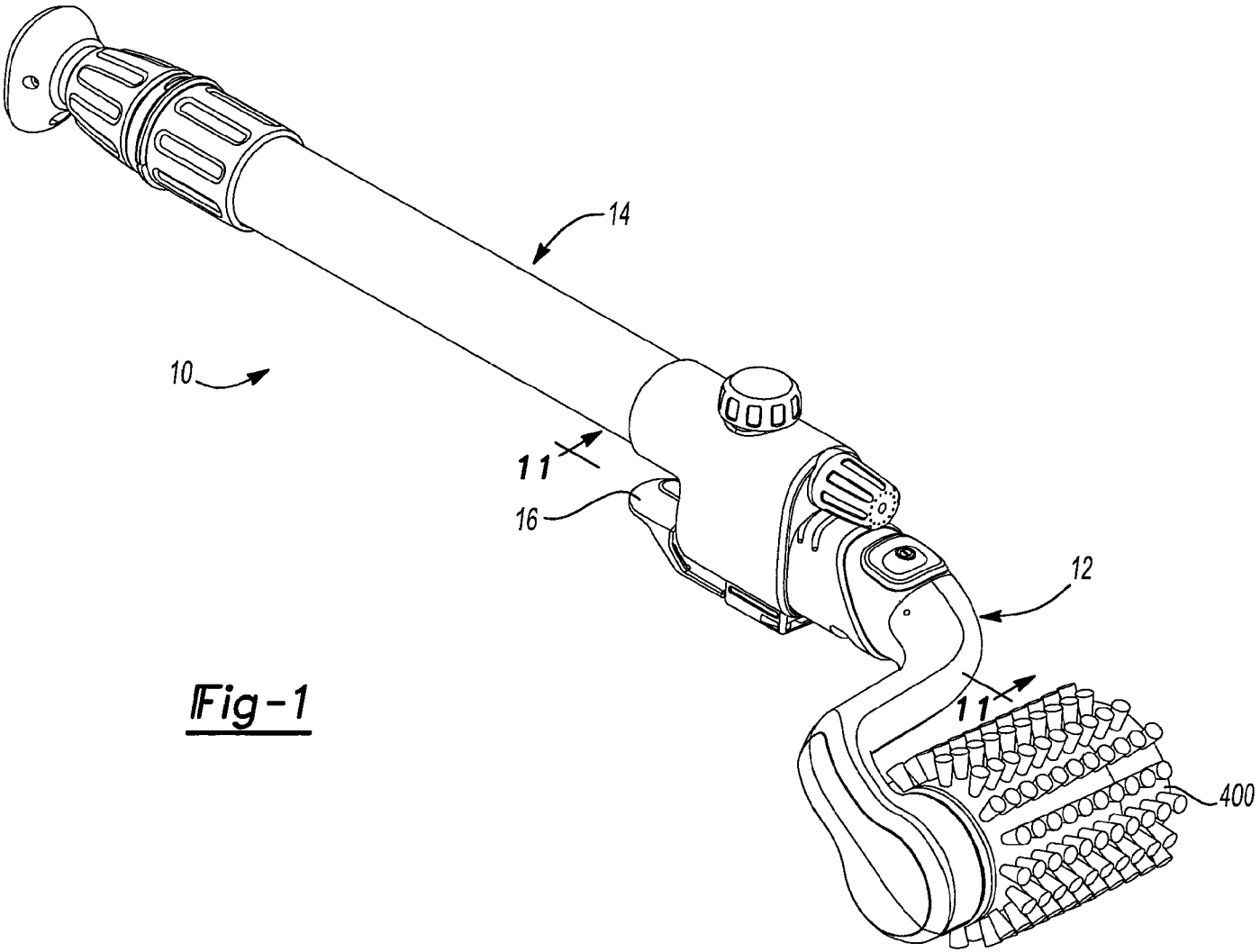
FIG. 1 is a perspective view of a hand-held motorized cleaning apparatus constructed in accordance with the teachings of the present disclosure.
Figure 2:
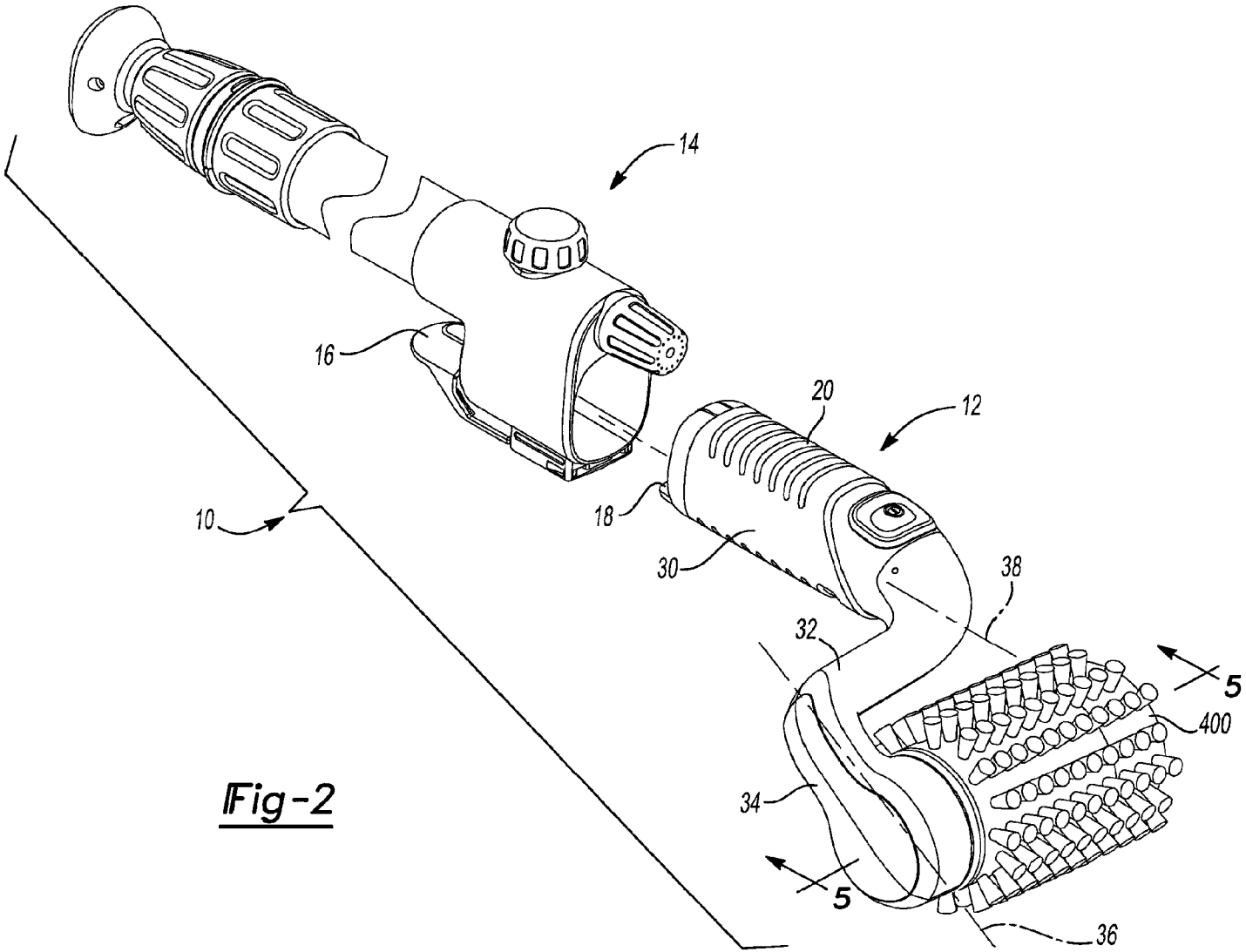
FIG. 2 is an exploded perspective view of the apparatus of FIG. 1, illustrating the main unit and the dispenser in more detail.

With reference to FIGS. 1 and 2 of the drawings, a hand-held motorized cleaning apparatus constructed in accordance with the teachings of the present invention is generally indicated by reference numeral 10. The hand-held motorized cleaning apparatus (apparatus) 10 can include a main unit 12, a dispenser 14, a clamp 16, and a clamp structure 18. The clamp 16 and the clamp structure 18 permit the main unit 12 and the dispenser 14 to be removably coupled to one another.

Figure 3:
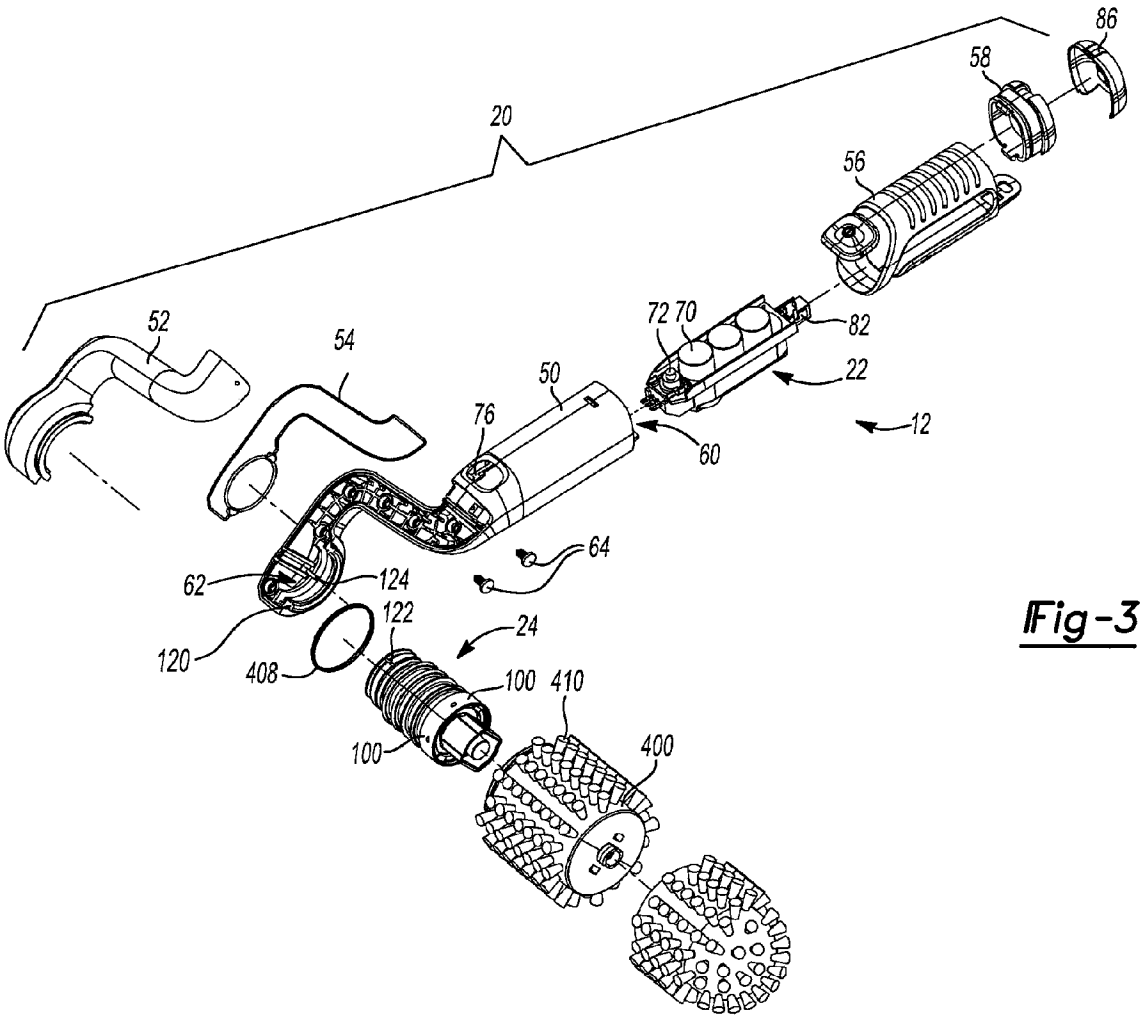
FIG. 3 is an exploded perspective of the main unit.
Figure 4:
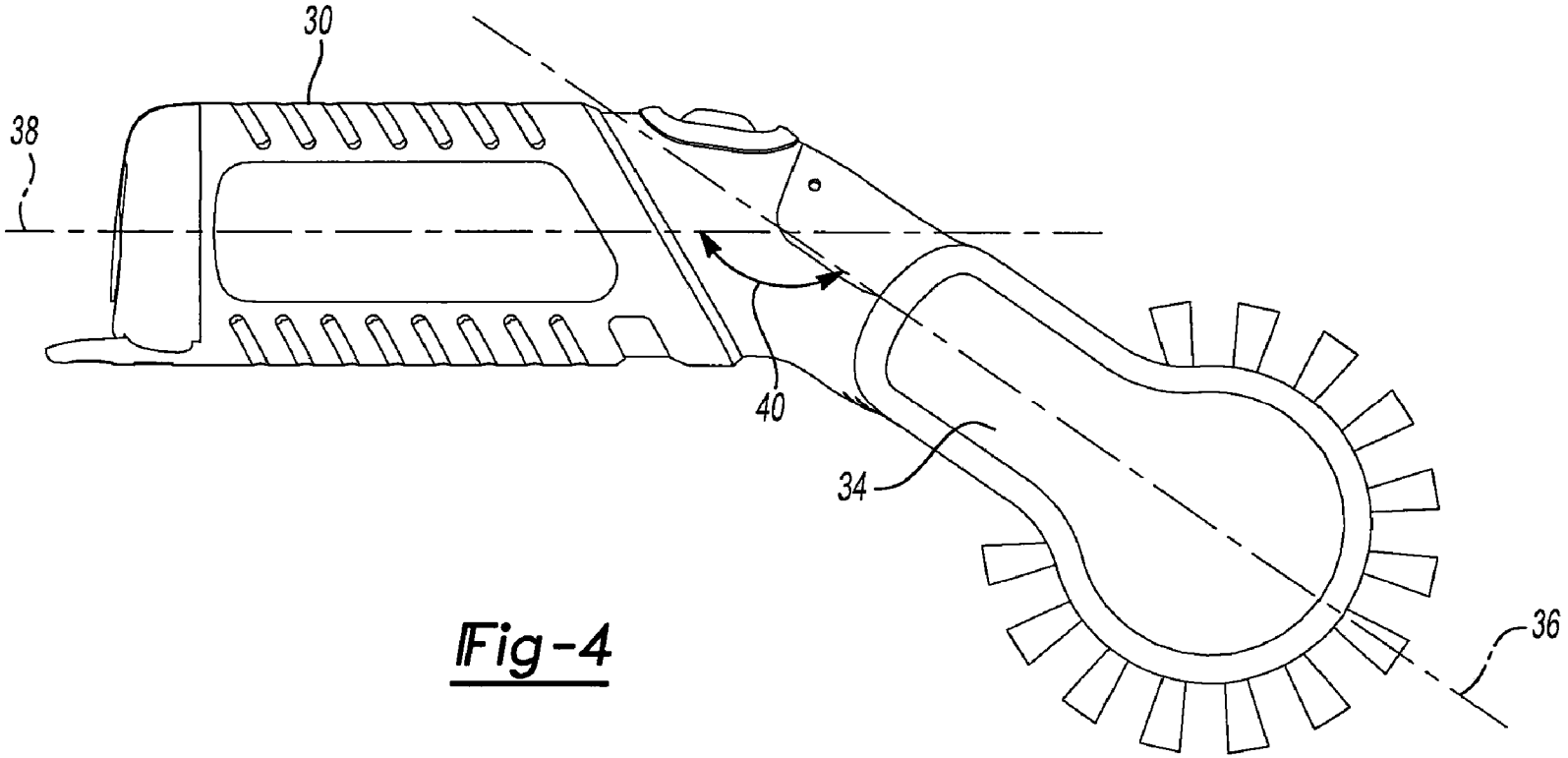
FIG. 4 is a side elevation view of the main unit.

In FIG. 3, the main unit 12 can include a housing 20, a battery assembly 22, and a motor assembly 24. With additional reference to FIGS. 2 and 4, the housing 20 can define a handle 30, a first extension portion 32 and a second extension portion 34. The first extension portion 32 can extend generally perpencidular to the handle 30. The second extension portion 34 can extend generally perpendicularly to the first extension portion 32. The second extension portion 34 can have a longitudinal axis 36 that can be skewed to a longitudinal axis 38 of the handle 30. In the particular example provided, an included angle 40 of about 120° to about 170° is defined between the longitudinal axis 36 of the second extension portion 34 and the longitudinal axis 38 of the handle 30. For purposes herein, the term "included angle" is defined as being the smallest angle between two components, such as the second extension portion 34 and the handle 30, rather than the smallest angle between their respective longitudinal axes.

Returning to FIG. 3, the housing 20 can include a first housing shell 50, a second housing shell 52, a gasket 54, a grip portion 56 and a housing cap 58. The first housing shell 50 and/or and second housing shell 52 can define a hollow cavity or battery aperture 60 in the handle 30 into which the battery assembly 22 can be received. The first and second housing shells 50 and 52 can also cooperate to form a hollow cavity or motor assembly aperture 62 in the second extension portion 34 into which the motor assembly 24 can be received. The gasket 54 can be disposed between the first and second housing shells 50 and 52, as well as between the motor assembly 24 and the first and second housing half shells 50 and 52. The first and second housing shells 50 and 52 can be coupled together via a plurality of screws 64. The grip portion 56 can be a discretely formed structure that can be coupled to the first housing shell 50 and/or the second housing shell 52, or could be formed by overmolding a suitable material, such as a thermoplastic elastomer, over selected portions of the first and second housing shells 50 and 52, such as the structure into which the battery aperture 60 is formed.

The battery assembly 22 can include a rechargeable battery set 70, a switch 72 and power leads (not specifically shown) that can be formed of wire. The battery assembly 22 can be received into battery aperture 60 in the handle 30 of the housing 20 such that the battery set 70 is located in the handle 30, the switch 72 extends through a switch aperture 76 that is formed in the first housing shell 50, and the power leads are routed through the housing 20 and interconnected to the motor assembly 24. An appropriate means may be employed to seal the interface between the switch 72 and the housing 20 to resist infiltration of liquid into the interior of the housing 20. For example, the grip portion 56 can be an overmolded thermoplastic elastomer material that can be employed to seal this interface. Alternatively, a seal (not shown), which may be a discretely formed component or which may be formed from an appropriate sealant material, can be employed to seal the interface between the switch 70 and the housing 20.

Figure 12:
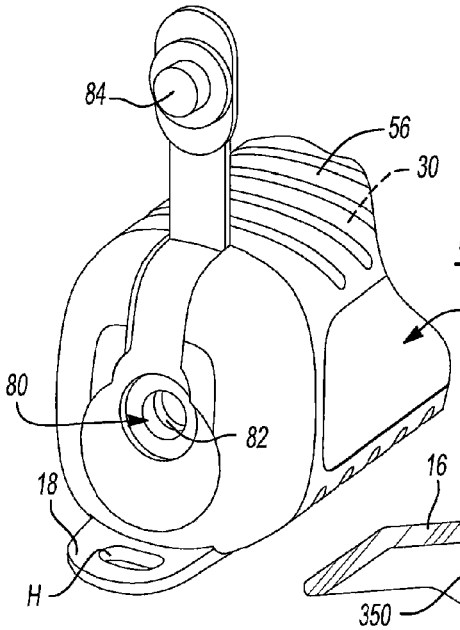
FIG. 12 is a rear perspective view of a portion of the main unit.

The housing cap 58 can be employed to close the open end of the battery aperture 60. With brief additional reference to FIGS. 6 and 12, the housing cap 58 can include a port 80 through which a recharging terminal 82 associated with the battery assembly 22 is accessible. The housing cap 58 can further include a lid 84 to close the port 80 to guard against infiltration of debris and/or liquids into the interior of the housing 20 through the port 80. The lid 84 can be integrally formed with an elastomeric cover 86 that can be coupled to the housing cap 58. The elastomeric cover 86 can be a thermoplastic elastomer that can be molded onto the housing cap 58 or could be a discrete component that can be coupled to the housing cap 58.

Those of skill in the art will appreciate that various gaskets and/or overmolds (e.g., gasket 54, grip portion 56, elastomeric cover 86 and lid 84) can be employed to seal the apparatus 10, either in part or in whole, so that it (or portions of it) may be submerged in a suitable liquid, such as water.

Figure 5:
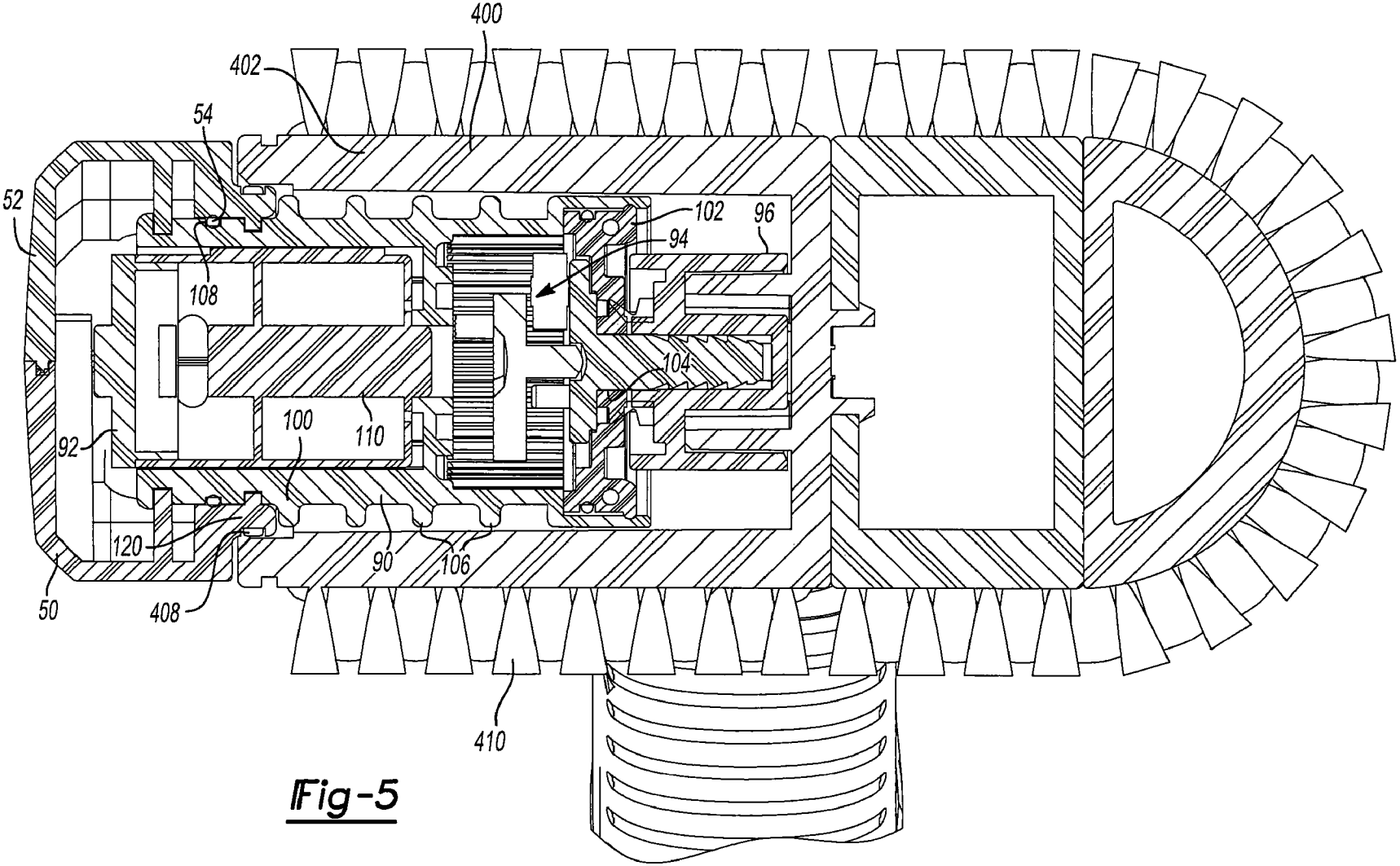
FIG. 5 is a sectional view taken along the line 5-5 of FIG. 2.

With reference to FIG. 5, the motor assembly 24 can include a gear case 90, a motor 92, a transmission 94 and an output member 96. The gear case 90 can include first and second longitudinally extending case halves 100 and an end plate 102 that can be coupled together to define a container-like structure having a hole 104 formed therethrough. The exterior of the gear case 90 can include a plurality of circumferentially extending ribs 106, as well as a circumferential land 108 that is configured to abut and sealingly engage the gasket 54. The transmission 94 can be a planetary-type transmission that can interconnect an output shaft 110 of the motor 92 to the output member 96 to permit the motor 92 to drive the output member 96. The transmission 94 is received into the gear case 90 and the motor 92 can be press-fit into the gear case 90. The motor 92 can be operated to drive the output member 96 in a predetermined direction or could be a reversible motor whose rotational direction may be chosen by the operator via an input means, such as a three position power switch (not shown) that would be substituted for the switch 72.

With additional reference to FIG. 3, the motor assembly 24 can be received through the motor assembly aperture 62 such that the motor 92 can be coupled to the wires and the gasket 54 disposed about the gear case 90. The first and second housing shells 50 and 52 can each include flanges 120 that are configured to clamp about the gear case 90. More particularly, the gasket 54 is disposed between the flanges 120 and the gear case 90 and the flanges 120 transmit a compressive force (generated by the screws 64) that clamps the gear case 90 in place as well as sealingly engages the gasket 54 to both the housing 20 and the gear case 90. Locking features 122 can be formed onto the gear case 90 and/or the motor 92 and can be employed to engage mating features 124 on the housing 20 to non-rotatably couple the motor assembly 24 to the housing 20. In the particular example provided, the locking features 122 include a longitudinally extending slot formed in the gear case 90, while the mating features 124 include a rib that is formed on the first housing shell 50 and which is received into the slot (i.e., the locking feature 122) when the motor assembly 24 is mounted to the housing 20.

Figure 7:
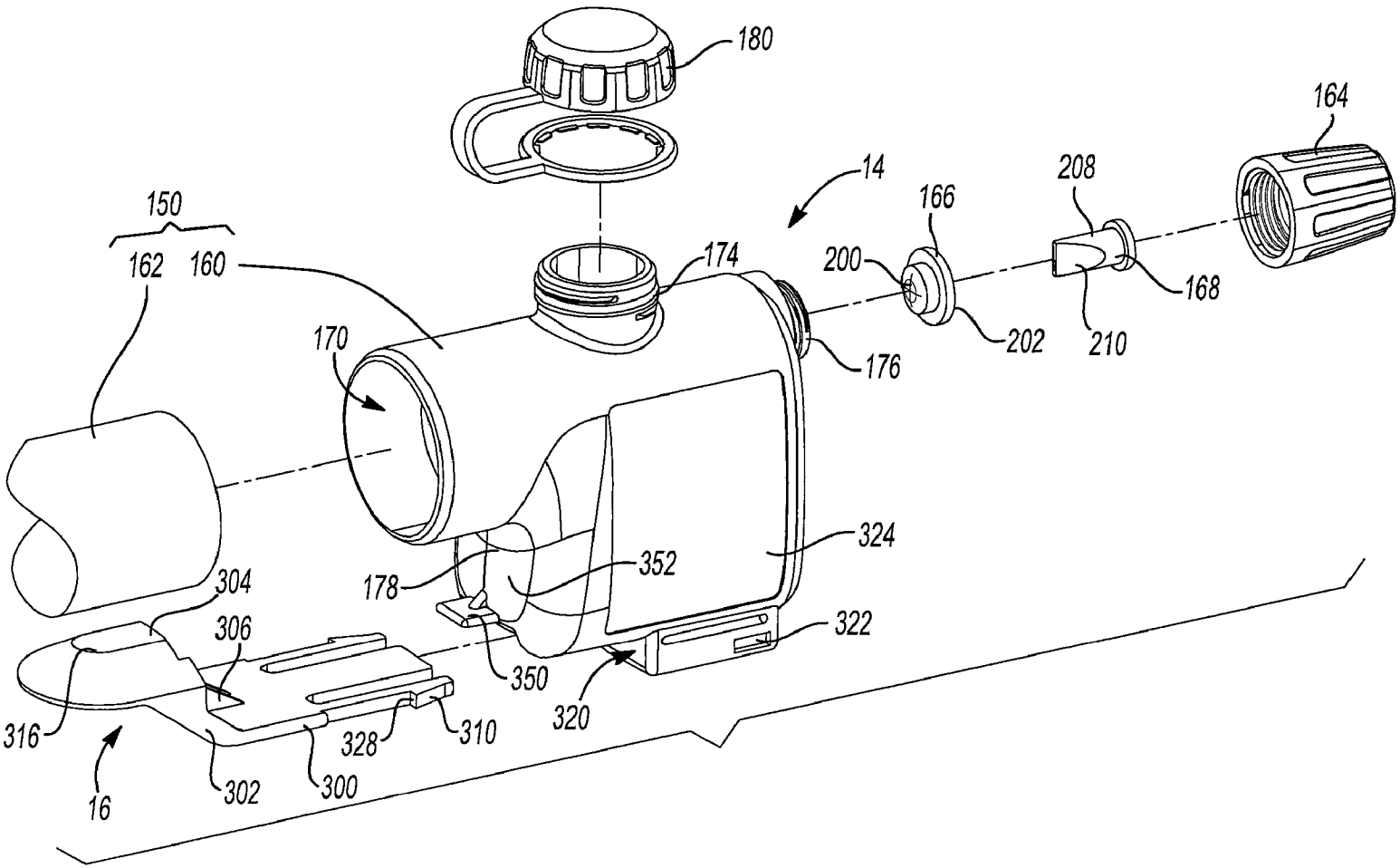
FIG. 7 is an exploded perspective view of a portion of the apparatus of FIG. 1, illustrating the body, the cylinder, the nozzle, the first valve and the second valve of the dispenser.
Figure 8:
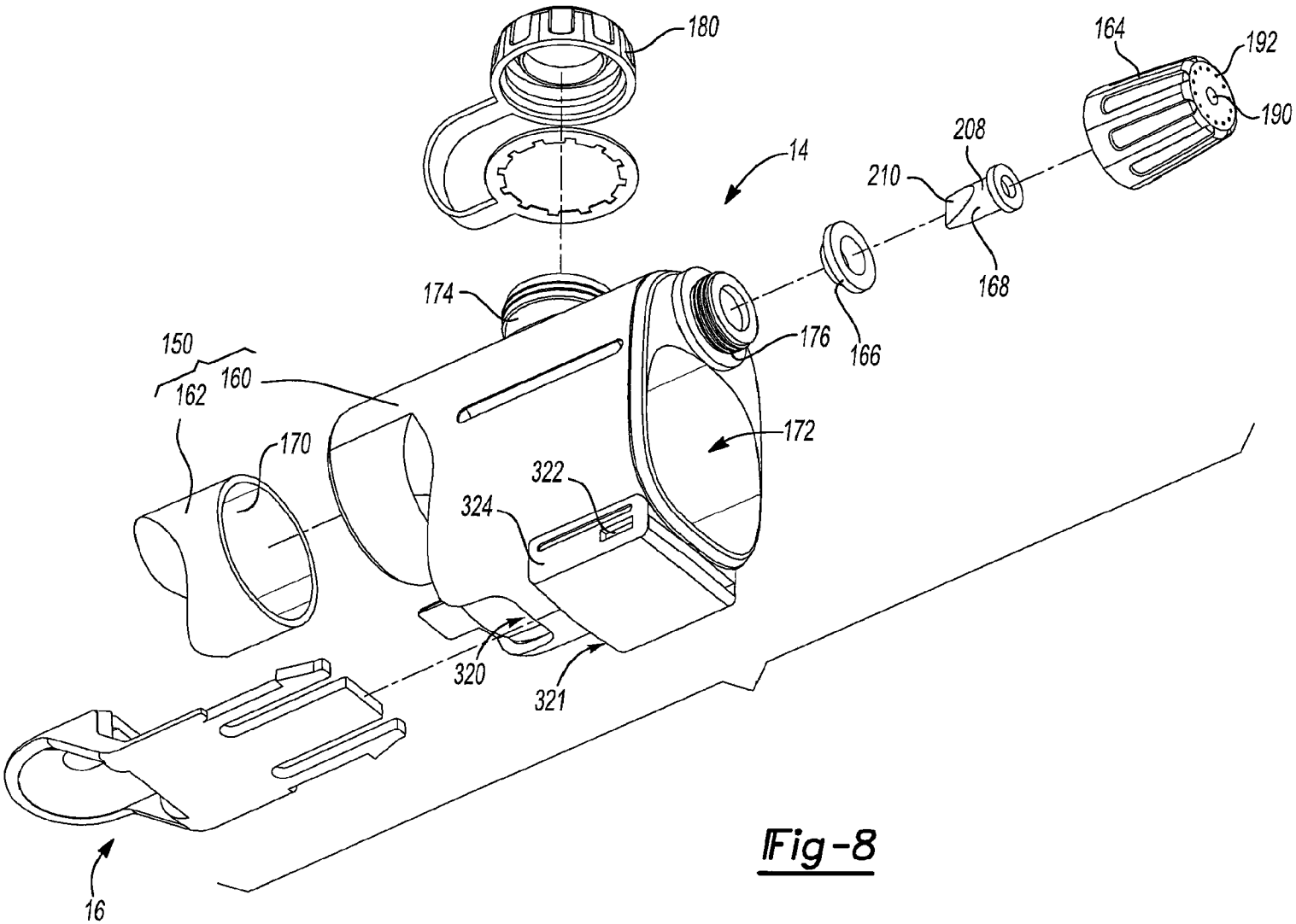
FIG. 8 is an exploded perspective view of a portion of the apparatus of FIG. 1 illustrating the clamp and a portion of the dispenser in greater detail.
Figure 9:
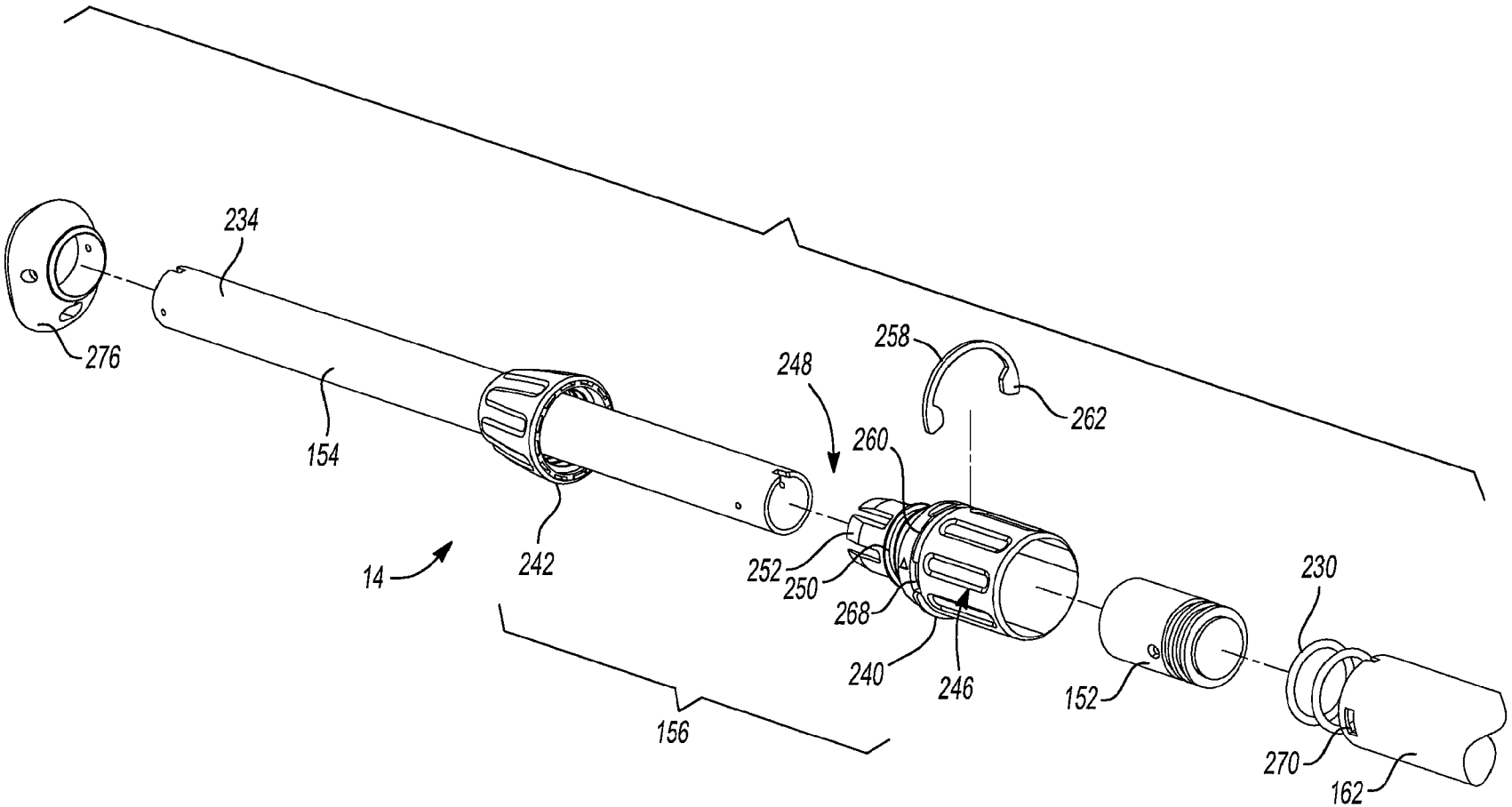
FIG. 9 is an exploded perspective view of a portion of the dispenser, illustrating the rod and piston in more detail.

With reference to FIGS. 7-9, the dispenser 14 can include a body 150, a piston 152, a rod 154, and a lock 156. The body 150 can include a body housing 160, a cylinder 162, a nozzle 164, a first valve 166 and a second valve 168. The body housing 160 and/or the cylinder 162 can define a reservoir 170. In the particular embodiment illustrated, the body housing 160 and the cylinder 162 cooperate to define the reservoir 170 for storage of a suitable cleaning fluid, such as water. The body housing 160 can define a body aperture 172, a fill neck 174 and a conduit 176. The body aperture 172 can be sized to receive the handle 30 of the main unit 12. The body aperture 172 can be formed through the body housing 160, but in the example provided an end wall 178 substantially closes a rear end of the body aperture 172. The fill neck 174 can be a threaded nipple that can be coupled in fluid communication with the reservoir 170. A filler cap 180 or other suitable closure means, such as a stopper, can be coupled (e.g., threadably coupled) to the filler cap 180. The conduit 176 can be integrally formed with the body housing 160.

The nozzle 164 can be coupled (e.g., threadably coupled) to the conduit 176. In the particular example provided, the nozzle 164 includes an internal hollow stem 190, a plurality of relatively small diameter nozzle apertures 192, which are disposed about the hollow stem 190, and an annular wall member 194. Optionally, a screen or suitable filter can be fitted over or into the hollow stem 190 to prevent ingress of relatively large sized particles into the nozzle 164.

Figures 10, 11:
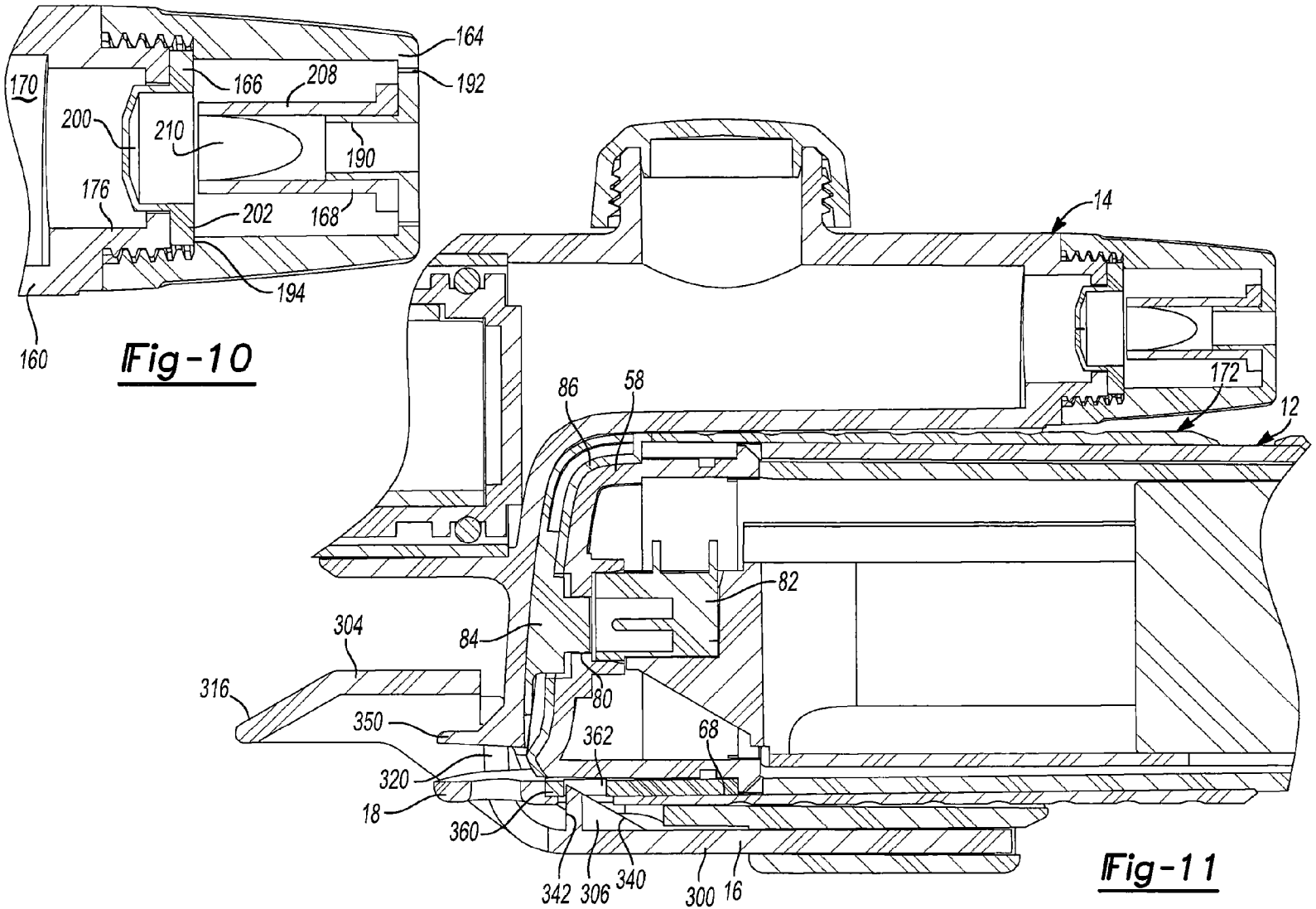
FIG. 10 is a longitudinal section view of a portion of the dispenser illustrating the nozzle, the first valve and the second valve in more detail.
FIG. 11 is a sectional view taken along the line 11-11 of FIG. 1.

With specific reference to FIGS. 7 and 10, the first valve 166 can be disposed between the reservoir 170 and the nozzle 164. The first valve 166 can be a normally closed valve but can open to permit fluid communication therethrough in response to application of a pressure differential thereon that exceeds a predetermined pressure threshold. In the particular example provided, the first valve 166 is a burst valve (i.e., a "no-drip" valve) that is formed of a resilient material and which includes a pair of intersecting but self-closing slits 200 and an annular seal member 202 that can be disposed between an end of the conduit 176 and the annular wall member 194 of the nozzle 164.

The second valve 168 can be a one-way valve that can be coupled in fluid communication with the reservoir 170. In the particular example provided, the second valve 168 is a duckbill valve that is formed of a resilient material. The second valve 168 can have a hollow-cylindrical body 208 that can be received over and seal the outer diameter of the hollow stem 190 of the nozzle 164, and a pair of lip members 210 that are biased inwardly to cause the lip members 210 to seal against one another.

With reference to FIG. 9, the piston 152 can be slidably movably received in the cylinder 162. The piston 152 can carry one or more seal rings 230 that can sealingly engage an inner diameter of the cylinder 162. The rod 154 can be fixedly coupled to the piston 152 (e.g., via a transverse pin or screw, not shown) and can define a second handle 234. It will be appreciated that the rod 154 may be moved to cause a corresponding movement of the piston 152 and that such movement of the piston 152 affects the volume of the reservoir 170.

The lock 156 can be any type of locking mechanism that can be employed to selectively lock the rod 154 at a given position relative to the cylinder 162. Accordingly, it will be appreciated that the lock 156 can be employed to maintain the rod 154 at a given position relative to the body housing 160 to permit the reservoir 170 to be filled via the fill neck 174 or to permit the rod 154 to function as a telescoping handle. In the particular example provided, the lock 156 is a collet-type lock that includes a collet body 240 and a collet nut 242. The collet body 240 includes a first portion 246 which is sized to be received over an end of the cylinder 162 opposite the body housing 160, and a second portion 248 that includes a threaded segment 250 and a plurality of cantilevered fingers 252. The first portion 246 can be secured to the rod 154 in any desired manner. For example, an external snap ring 258 can be received into a groove 260 formed about the first portion 246; inwardly extending ears 262 on the snap ring 258 can be received through first slots 268 that can be formed through the first portion 246, as well as through or into second slots 270 formed through the cylinder 162. As the inwardly extending ears 262 can extend into the interior diameter of the cylinder 162, the piston 152 can contact the inwardly extending ears 262 to limit movement of the piston 152 in a direction away from the body housing 160 (FIG. 7). The rod 154 is received through the collet body 240 and the collet nut 242 is threadably engaged to the second portion 248 of the collet body 240. The collet nut 242 is configured to drive the cantilevered fingers 252 radially inwardly to grip against the outer diameter of the rod 154 to thereby lock the rod 154 relative to the cylinder 162. A cap member 276 can be employed to close an end of the rod 154 opposite the piston 152.

With reference to FIG. 11, the clamp 16 and the clamp structure 18 can cooperate to fixedly but removably couple the main body 12 and the dispenser 14 to one another. While the clamp 16 and the clamp structure 18 are described herein as being directly connected to the reservoir 170 and the main body 12, respectively, it will be appreciated that the clamp 16 and the clamp structure 18 could be coupled to the main body 12 and the reservoir 170, respectively.

With renewed reference to FIGS. 7 and 8, the clamp 16 can be generally Z-shaped and can include a first portion 300, a second portion 302, a third portion 304 and a first engagement member 306. The first portion 300 can be generally planar and can include a pair of laterally-deflectable bayonets 310. The second portion 302 can include a pair of side members that can couple the first portion 300 to the third portion 304. The third portion 304 can define an actuator 316 that can be employed to operate the clamp 16. The clamp 16 can be pivotally coupled to the main body 12 in any desired manner, such as via the bayonets 310. In the example provided, the first portion 300 is received through a securing aperture 321 in the end wall 178 of the body housing 160 and the bayonets 310 can be received through bayonet apertures 322 in the opposite lateral side walls 324 of the body housing 160. The bayonets 310 are forwardly tapered and have an abutting rear wall 328. Contact between the forwardly tapered outer side of the bayonets 310 and the side walls 324 of the body housing 160 permits the body housing 160 to urge the bayonets 310 inwardly. With additional reference to FIG. 11, the first engagement member 306 can be fixedly coupled (e.g., integrally formed with) the first portion 300 and can include a rearwardly and upwardly tapering ramp 340 and an abutting surface 342.

Once aligned to the bayonet apertures 322, the bayonets 310 can move outwardly such that the abutting rear walls 328 are engaged to the body housing 160. In this condition, the first engagement member 306 can be disposed in the coupling aperture 320. Once coupled to the body housing 160, downward pressure can be applied to the actuator 316 to cause the first portion 300 to deflect in a manner that lowers the first engagement member 306 relative to the coupling aperture 320. A stop member 350 can be coupled to a rear side 352 of the end wall 178. Contact between the stop member 350 and the third portion 304 can limit downward movement of the first portion 300 to prevent plastic deformation or breakage of the first portion 300.

Figure 6:
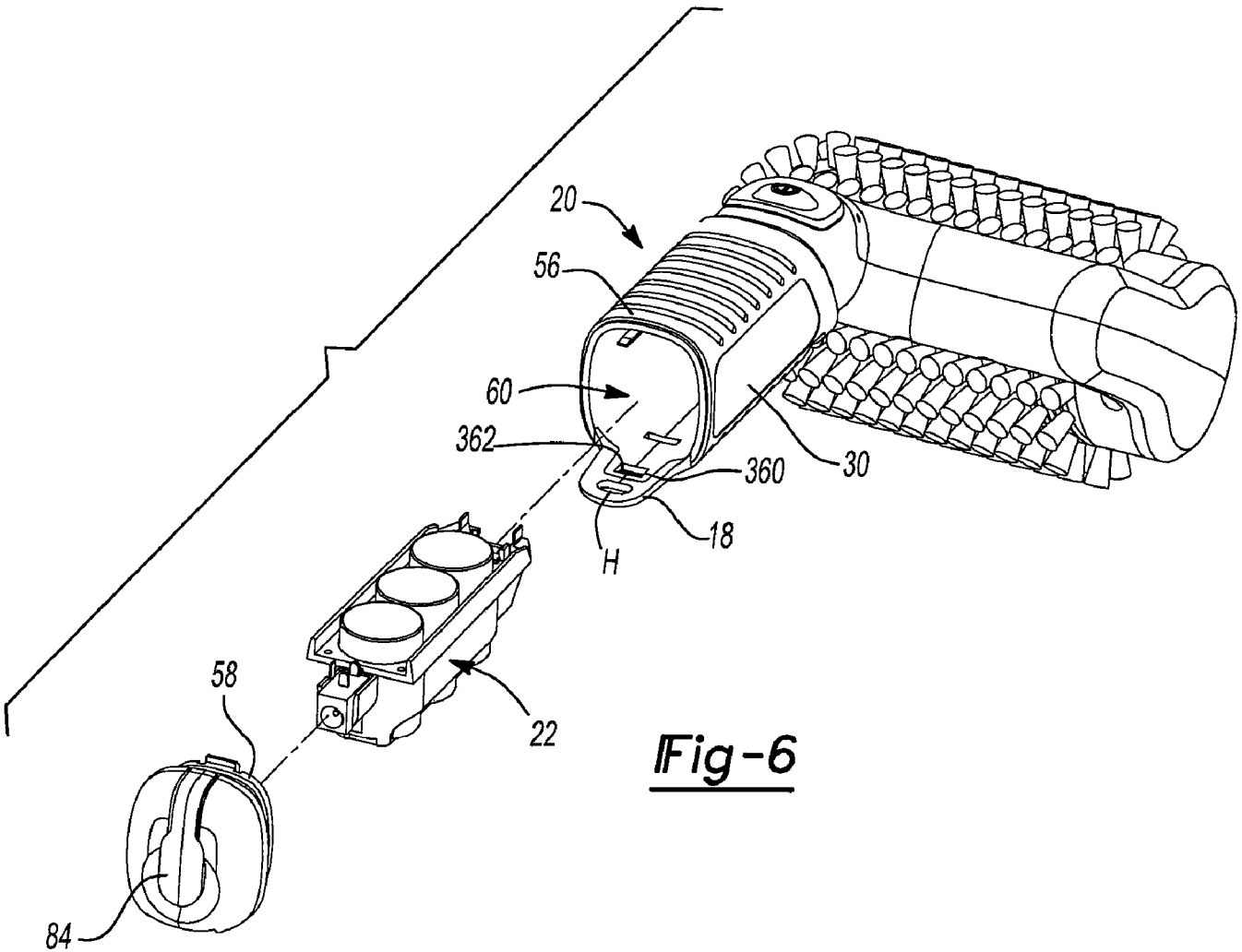
FIG. 6 is an exploded view of a portion of the main unit.
Figure 13:
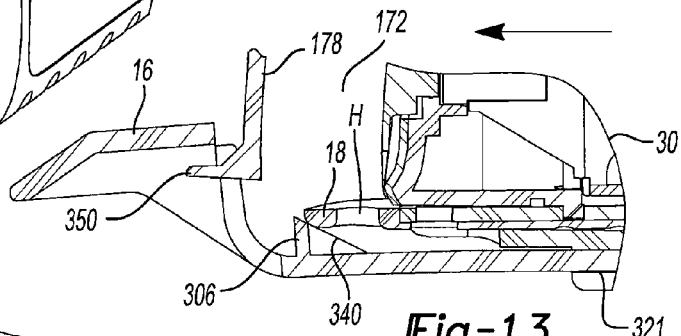
FIG. 13 is a longitudinal section view taken through a portion of the apparatus of FIG. 1, illustrating the insertion of the main unit to the dispenser prior to the coupling of the clamp and the clamp structure.
Figure 14:
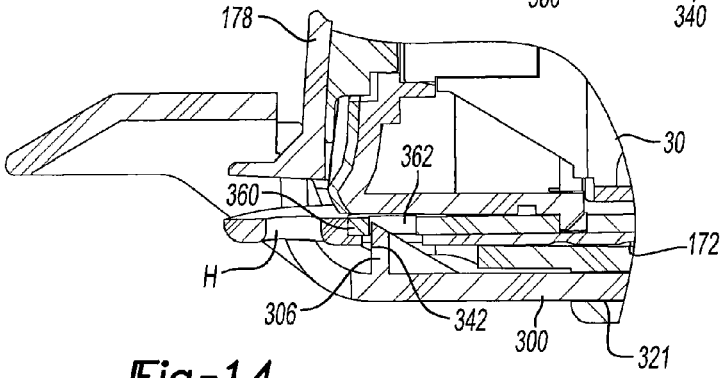
FIG. 14 is a view similar to the view of FIG. 13 but illustrates the main unit as being fully installed to the dispenser and the clamp as coupled to the clamp structure.

In FIGS. 6 and 11, the clamp structure 18 can be coupled to the housing 20 and can include a second engagement member 360 that can be configured to releasably engage the first engagement member 306. In the particular example provided, the second engagement member 360 defines a ramp aperture 362 through which the first engagement member 306 can be received. An aperture H may be formed into the clamp structure 18 to permit the main unit 12 to be hung on a hook (not shown). While not shown, an elastomeric material, such as a portion of the grip portion 56 that can be coupled to the handle 30, can be disposed about and at least partially define the ramp aperture 362. In operation, the handle 30 can be received into the body aperture 172 such that the clamp structure 18 is received through the coupling aperture 320. The clamp structure 18 can contact the rearwardly and upwardly tapering ramp 340 on the first engagement member 306 as the handle 30 is being moved into the body aperture 172, which can cause the clamp 16 to pivot or deflect downwardly as shown in FIG. 13. Alignment of the first engagement member 306 to the ramp aperture 362 permits the first portion 300 to return in an upward direction such that the first engagement member 306 is received in the ramp aperture 362 as shown in FIG. 14; contact between the abutting surface 342 and the second engagement member 360 (more specifically, abutment of the second engagement member 360 to the abutting surface 342) prevents withdrawal of the handle 30 from the body aperture 172. Moreover, the end wall 178 limits further rearward movement of the handle 30 relative to the dispenser 14.

Figure 15:
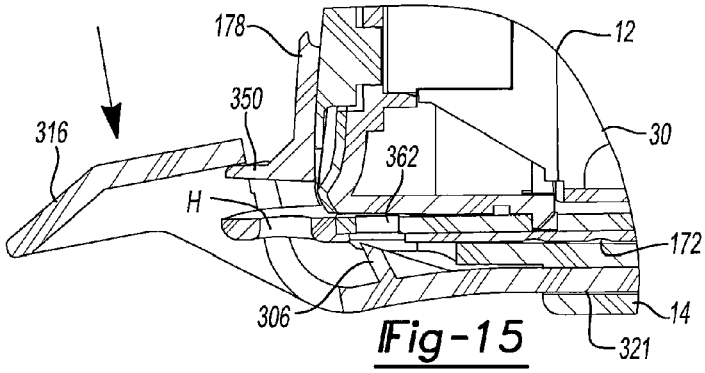
FIG. 15 is a view similar to the view of FIG. 14, but illustrates the clamp as being manipulated to disengage the clamp structure to permit the main unit to be withdrawn from the dispenser.

To remove or decouple the main unit 12 from the dispenser 14, downward pressure can be applied to the actuator 316 to lower the first engagement member 306 out of the ramp aperture 362 so that the main body 12 may be withdrawn from the body aperture 172 as shown in FIG. 15.

Figure 16:
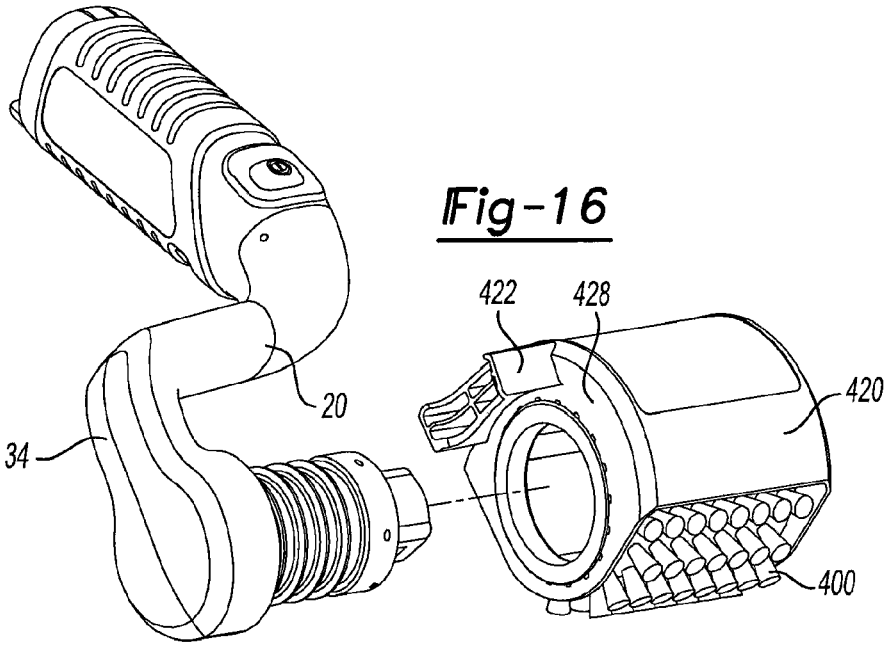
FIG. 16 is an exploded perspective view illustrating the main unit with another accessory constructed in accordance with the teachings of the present disclosure.
Figure 17:
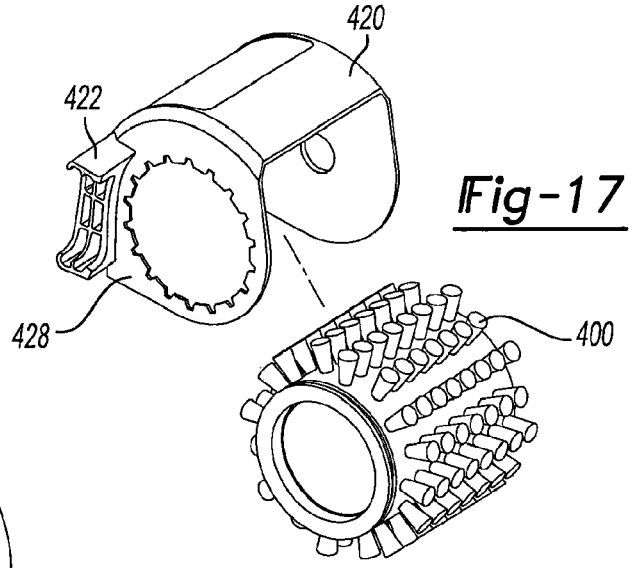
FIG. 17 is an exploded perspective view of the accessory of FIG. 16.
Figure 18:
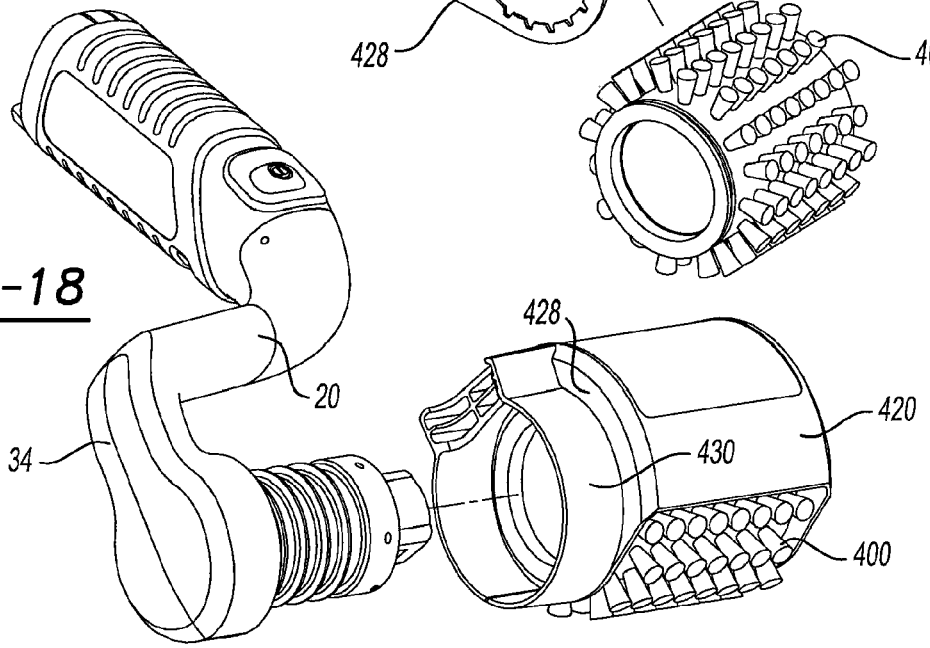
FIG. 18 is an exploded perspective view illustrating the main unit with yet another accessory constructed in accordance with the teachings of the present disclosure.

Various types of accessories may be driven with or employed by the main unit 12. In the example of FIGS. 3 and 5, a roller-brush accessory 400 is employed. The roller brush accessory 400 can have a hollow-cylindrical body 402 that can be received over the gear case 90 and which can be drivingly engaged to the output member 96. A ring 408 may be employed to close and/or seal an interface between the hollow-cylindrical body 150 and the main unit 12. For example, the ring 408 can be disposed circumferentially about the housing 20 and can apply a clamping force to the flanges 120 that drives the first and second housing shells 50 and 52 into sealing engagement with the gasket. Additionally or alternatively, the ring 408 could comprise a seal member that can be received over the flanges 120 and sealingly engage the housing 20 and the hollow-cylindrical body 402 of the accessory 400 to resist the infiltration of water and debris between the gear case 90 and the accessory 400. Alternatively, the seal or ring 408 could be carried by the roller brush accessory 400. The roller brush accessory 400 can employ one or more sets of bristles 410 and the bristles 410 can be formed of any desired material, such as a suitable plastic (e.g., nylon) or metal (e.g., bronze). An optional shield 420 can be coupled to the housing 20 to shield the operator from dirt and debris dislodged by the roller brush accessory 400 during operation as shown in FIGS. 16 and 17. For example, the shield 420 can include a yoke 422 that be configured to fit about a portion of the housing, such as the second extension portion 34, to thereby resist rotation of the shield 420 relative to the housing 20. The shield 420 can be fitted with one or more end caps 428 that shroud an associated lateral side of the roller brush accessory 400. Alternatively, the end cap 428 closet to the main unit 12 can employ a circumferentially extending shield member 430.

Figure 19:
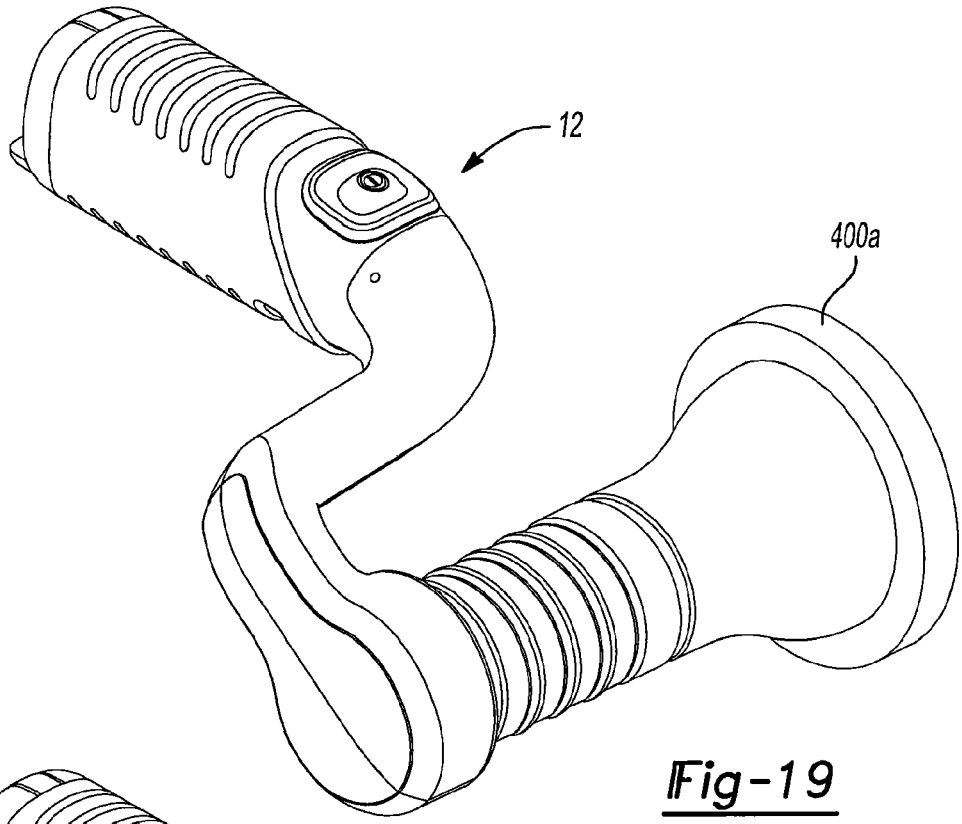
FIGS. 19 and 20 are perspective views illustrating the main unit with further accessories constructed in accordance with the teachings of the present disclosure.
Figure 20:
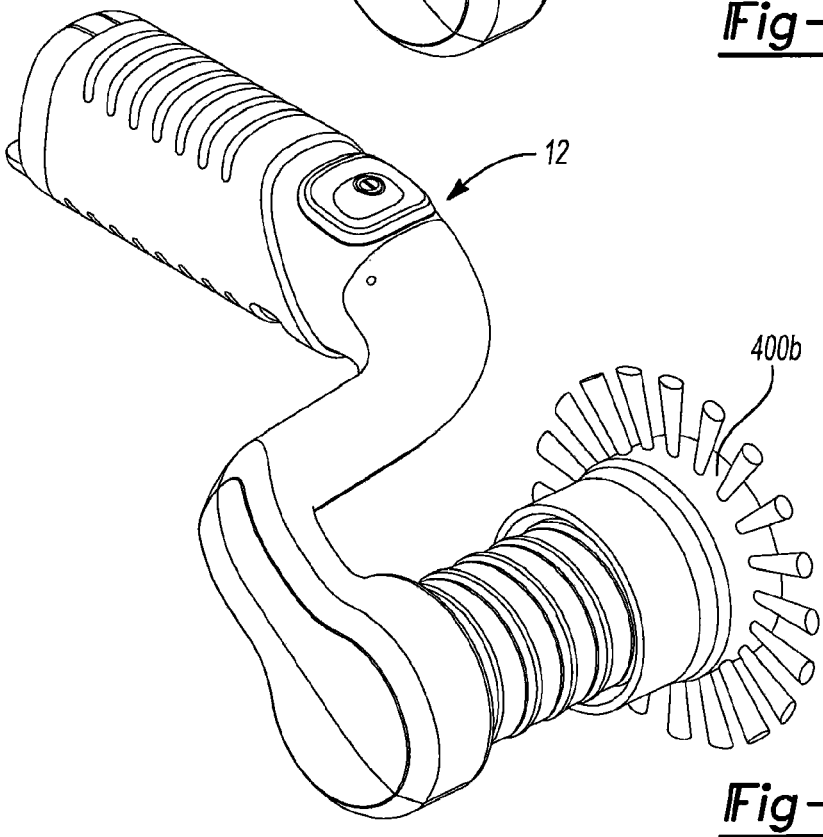

Those of skill in the art will appreciate that although the accessory has been illustrated and described herein as being a roller brush, other types of accessories may be employed with the main unit 12. For example, the roller could be formed of another suitable material, such as a sponge. As another example, an end-facing sponge attachment 400*a* or an end-facing brush attachment 400*b* can be employed as shown in FIGS. 19 and 20, respectively.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A hand-held motorized cleaning apparatus comprising:

a main unit including a housing, a battery located in the housing, a motor located in the housing and connected to the battery, and an output drive shaft powered by the motor;

a dispenser including a body, the body defining a body aperture and having a reservoir for storing a fluid, and a nozzle in fluid communication with the reservoir, the dispenser being selectively operable to permit the stored fluid to be dispensed from the reservoir through the nozzle;

a clamp coupled to one of the main unit and the dispenser, the clamp including a first engagement member that can be pivoted relative to the one of the main unit and the dispenser; and a clamp structure coupled to the other one of the main unit and the dispenser, the clamp structure including a second engagement member that can be releasably engaged to the first engagement member;

wherein the housing is received through the body aperture.

2. The hand-held motorized cleaning apparatus of claim 1, wherein the clamp is pivotally coupled to the other one of the main unit and the dispenser.

3. The hand-held motorized cleaning apparatus of claim 1, wherein the dispenser further comprises a cylinder assembly with a cylinder, which at least partially defines the reservoir, and a piston that is received in the cylinder, the piston being movable within the cylinder to vary a volume of the reservoir.

4. The hand-held motorized cleaning apparatus of claim 3, wherein cylinder assembly includes a lock mechanism for selectively locking the piston relative to the cylinder.

5. The hand-held motorized cleaning apparatus of claim 4, further comprising a valve disposed upstream of the nozzle, the valve opening when a pressure acting on the valve exceeds a predetermined gauge pressure to permit the stored fluid to be discharged through the nozzle.

6. The hand-held motorized cleaning apparatus of claim 5, further comprising a second valve coupled to the reservoir, the second valve opening in response to a predetermined gauge pressure to permit a fluid material to be drawn into the reservoir.

7. The hand-held motorized cleaning apparatus of claim 1, wherein the housing includes an upper housing, a lower housing and a gasket that is received between the upper housing and the lower housing.

8. The hand-held motorized cleaning apparatus of claim 7, wherein the main housing further comprises a transmission assembly with a gear case and a transmission received in the gear case, the transmission receiving a rotary input from the motor and driving the output drive shaft.

9. The hand-held motorized cleaning apparatus of claim 8, wherein the motor is press-fit into the gear case.

10. The hand-held motorized cleaning apparatus of claim 9, wherein the gear case is clamped between the upper housing and the lower housing.

11. The hand-held motorized cleaning apparatus of claim 10, wherein the gear case includes a first gear case half shell and a second gear case half shell.

12. The hand-held motorized cleaning apparatus of claim 9, wherein the gear case includes a first gear case half shell and a second gear case half shell.

13. The hand-held motorized cleaning apparatus of claim 8, wherein the gear case includes a first gear case half shell and a second gear case half shell.

14. The hand-held motorized cleaning apparatus of claim 8, further comprising an attachment coupled to the output drive shaft.

15. The hand-held motorized cleaning apparatus of claim 14, wherein an annular clamp ring is disposed between the main body and the attachment.

16. The hand-held motorized cleaning apparatus of claim 1, wherein the housing defines a handle, a first extension portion and a second extension portion, the first extension portion extending generally perpendicularly away from the handle, the second extension portion extending generally perpendicularly away from the first extension portion, the second extension portion having a longitudinal axis that is skewed to a longitudinal axis of the handle.

17. The hand-held motorized cleaning apparatus of claim 16, wherein an included angle between the longitudinal axis of the second extension portion and the longitudinal axis of the handle has a magnitude of about 120 degrees to about 170 degrees.

18. A hand-held cleaning apparatus comprising:

a main body having:

a first housing shell;

a second housing shell;

a battery assembly received between the first and second housing shells;

a motor assembly with a motor, a transmission, a gear case and an output member, the motor being electrically coupled to the battery assembly, the transmission coupling the motor to the output member, the gearcase having first and second longitudinally extending shell members, the transmission being received into the gear case, the motor being press-fit into the gear case; and a clamp structure coupled to the second housing shell;

wherein the first and second housing shells cooperate to form a first handle; and a dispenser having:

a body having a body housing and a cylinder, the body housing defining a body aperture, at least one of the body housing and the cylinder defining a reservoir;

a piston movably received in the cylinder;

a rod fixedly coupled to the piston and extending from the cylinder on a side opposite the body, the rod including a second handle;

a lock coupled to the cylinder, the lock being configured to selectively fix the rod relative to the cylinder;

a nozzle in fluid communication with the reservoir;

a first valve disposed between the nozzle and the reservoir, the first valve being normally closed but opening to permit fluid communication therethrough in response to application of a pressure differential thereon that exceeds a predetermined pressure threshold;

a second valve coupled in fluid communication with the reservoir, the second valve permitting fluid communication therethrough in a single direction when the piston is moved to expand a volume of the reservoir; and a clamp pivotally coupled to the body, the clamp being configured to engage the clamp structure when the first handle is received in the body aperture.

* * * * *